US009260971B2

(12) United States Patent
Yoshida et al.

(10) Patent No.: US 9,260,971 B2
(45) Date of Patent: Feb. 16, 2016

(54) TURBINE ROTOR

(75) Inventors: Toyotaka Yoshida, Tokyo (JP); Katsuyuki Osako, Tokyo (JP); Takao Yokoyama, Tokyo (JP); Motoki Ebisu, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 461 days.

(21) Appl. No.: 13/256,151

(22) PCT Filed: Aug. 10, 2010

(86) PCT No.: PCT/JP2010/063580

§ 371 (c)(1),
(2), (4) Date: Dec. 14, 2011

(87) PCT Pub. No.: WO2011/043124

PCT Pub. Date: Apr. 14, 2011

(65) Prior Publication Data

US 2012/0183406 A1 Jul. 19, 2012

(30) Foreign Application Priority Data

Oct. 7, 2009 (JP) ..... 2009-233182

(51) Int. Cl.
*F01D 5/04* (2006.01)
*F01D 5/02* (2006.01)
*F01D 5/06* (2006.01)

(52) U.S. Cl.
CPC ..... *F01D 5/048* (2013.01); *F01D 5/026* (2013.01); *F01D 5/063* (2013.01); *F05D 2230/232* (2013.01); *F05D 2260/941* (2013.01)

(58) Field of Classification Search
CPC ..... F01D 5/14; F01D 5/04; F01D 5/048; F01D 5/063; F02B 39/00; F04D 29/28; F05D 2260/961
USPC ..... 416/185, 186 R
See application file for complete search history.

(56) References Cited

U.S. PATENT DOCUMENTS 4,687,412 A * 8/1987 Chamberlain ..... 415/134
4,787,821 A 11/1988 Cruse et al.

(Continued)

FOREIGN PATENT DOCUMENTS

CA 2207140 11/1997
CN 1847669 A 10/2006

(Continued)

OTHER PUBLICATIONS

Chinese Office Action and English translation thereof dated Oct. 17, 2013 for Patent Application No. 201080009829.8.

(Continued)

*Primary Examiner* — Richard Edgar
*Assistant Examiner* — Juan G Flores
(74) *Attorney, Agent, or Firm* — Birch, Stewart, Kolasch & Birch, LLP

(57) ABSTRACT

Providing a turbine rotor in which the rotational inertia of the turbine rotor can be reduced without changing the geometry of the blade part, whereas the turbine rotor is provided with the rear side surface so that the stress concentration appearing at the root part regarding the hub part on the rear surface side is constrained in order that the strength and the durability of the turbine rotor can be enhanced. A turbine rotor that comprises a hub part 9 connected to a rotor shaft 19 and a plurality of blade parts 11 formed around the outer periphery of the hub part 9, the hub part and the blade parts being integrated into one piece, wherein the diameter of the hub part 9 around the rotation axis L of the rotor shaft 19 gradually increases along the rotation axis direction toward a rear side surface 7 on an end side regarding the rotation axis direction; an annular recess 21 is formed annularly around the rotation axis as a rotation center line, on the side of the rear side surface 7 of the hub part 9; the cross-section of the annular recess whose plane includes the rotation axis is configured with a part of the major arc C of an oval shape or an egg shape, the major arc C being formed so that the oval shape or the egged shape is divided by the major axis b as a symmetrical axis of the oval shape or the egged shape; and, the major axis b is placed in the rear side surface 7.

8 Claims, 4 Drawing Sheets

(56) References Cited

U.S. PATENT DOCUMENTS

| | | | | |
|---|---|---|---|---|
| 4,850,802 | A | 7/1989 | Pankratz et al. | |
| 6,364,634 | B1 | 4/2002 | Svihla et al. | |
| 6,563,074 | B2 * | 5/2003 | Bazukuri et al. | 219/121.14 |

FOREIGN PATENT DOCUMENTS

| | | | | | |
|---|---|---|---|---|---|
| DE | 1 083 481 | | | 6/1960 | |
| EP | 1 467 062 | A2 | | 10/2004 | |
| EP | 1 956 189 | A1 | | 8/2008 | |
| GB | 1 344 520 | A | | 1/1974 | |
| GB | 1 515 296 | | | 6/1978 | |
| GB | 2 058 941 | A | | 4/1981 | |
| JP | 59-15601 | | * | 1/1984 | F01D 5/04 |
| JP | 59-15601 | A | | 1/1984 | |
| JP | 59-25083 | B2 | | 6/1984 | |
| JP | 59-128902 | A | | 7/1984 | |
| JP | 59-135303 | | * | 9/1984 | F01D 5/04 |
| JP | 59-135303 | U | | 9/1984 | |
| JP | 60-39737 | U | | 3/1985 | |
| JP | 63-83430 | U | | 6/1988 | |
| JP | 1-15719 | B2 | | 3/1989 | |
| JP | 10-54201 | A | | 2/1998 | |

OTHER PUBLICATIONS

Japanese Decision to Grant a Patent and English translation thereof, dated Nov. 19, 2013, for Patent Application No. 2009-233182.

Korean Notice of Allowance dated Jul. 23, 2013 for Korean Application No. 10-2011-7020199 with English translation.

Decision to Grant a Patent issued Feb. 26, 2014 in corresponding Japanese Application No. 2013-101307 and an English Translation.

European Search Report dated Jun. 24, 2014 issued in corresponding EP Application No. 10821795.1.

Chinese Notice of Allowance, dated Nov. 15, 2014, for Chinese Application No. 201080009829.8, with an English translation.

* cited by examiner

Geometry of blades in cross-section

TURBINE ROTOR

BACKGROUND OF THE INVENTION

1. Field of the Invention

The present invention relates to the turbine rotor of a radial or mixed flow type turbine that is used in turbochargers and the like; the present invention especially relates to the rear side surface geometry of the turbine rotor.

2. Background of the Invention

In the turbine rotors of the turbochargers used for vehicle engines, marine engines and the like, when turbine rotor has a great deal of rotational inertia (moment of inertia), the start-up characteristic regarding the engine speed as well as the charging air pressure is deteriorated, as shown in FIG. 7 that shows a response characteristic regarding the engine system in which the turbocharger is included; a result, a time lag regarding the response characteristic is generated between a time point when the inputted gas condition is changed and a time point when the engine speed as well as the charging air pressure is kept in a steady state.

Accordingly, as a method to reduce the rotational inertia of the turbine rotor, an approach to arrange the geometry of the turbine rotor by removing or cutting a part of the blade is known.

For instance, an approach as shown in FIG. 8 is known; thereby, the original shroud line (i.e. the tip end side line regarding the rotor blade) 05 is lowered toward the rotation axis, to an alternative line so that the height of the trailing edge 03 of the blade 01 is reduced, Further, an approach as shown in FIG. 9 is known; thereby, the thickness of the blade 01 is reduced to the thickness of the blade 01'; or the position of the shroud line as well as the leading edge 07 is lowered so that the turbine itself is down-sized.

In a case of the approach where the height of the trailing edge 03 of the blade 01 is reduced or the approach where the thickness of the blade is reduced as described above, however, the approach may cause efficiency deterioration or spoil the strength requirement. In addition, in a case of an approach where the downsized turbine rotor is used, the turbocharger has to bypass a part of pressurized charging air, the to-be-bypassed flow rate reaching the difference between the flow rate at the maximum torque point and the flow rate at the maximum output point; thus, there may be a difficulty that the efficiency of the whole system is reduced.

Hence, it has been proposed to provide a recess part on the rear surface side of the turbine rotor so that the rotational inertia is reduced without changing the blade geometry, the recess part being formed as a concave part of the rear surface by removing a part of the mass of the rotor (hub) on the rear surface side.

For instance, Patent Reference 1 (JP1998-54201) discloses a turbine rotor as depicted in FIG. 10; thereby, on the side surface 016 of the hub 015 on which a plurality of blades 013 of the turbine rotor 011 is provided, an annular recess part 017 is formed, the depth direction of the recess being parallel to the rotation axis direction of the turbine rotor.

Further, Patent Reference 2 (JP1988-83430) discloses a turbine rotor as depicted in FIG. 11; thereby, on the side surface 025 of the hub 024 on which a plurality of blades 022 of the turbine rotor 020 is provided, a plurality annular recess parts 026 is formed, the depth direction of the recess being parallel to the rotation axis direction of the turbine rotor. The number of the recess parts 026 is thereby four; each annular recess part is formed along the hoop direction as well as the rotation axis direction regarding the turbine rotor; the recess part in a cross-section whose plane includes the rotation axis is formed in a rough approximation of a triangle shape.

REFERENCES

Patent References

Patent Reference 1: JP1998-54201
Patent Reference 2: JP1988-83430

SUMMARY OF THE INVENTION

Subjects to be Solved

According to the disclosure of Patent Reference 1 or 2, the rotational inertia (moment of inertia) of the turbine rotor can be reduced by providing the recess part formed as the concave part by removing a part of the mass of the rotor (hub), so as to improve the response performance; however, in the case where the approach of Patent Reference 1 is applied, the curvature radius of the curved surface in the neighborhood of the recess bottom 019 of the annular recess is so small that the stress concentration is caused, the recess bottom 019 being depicted in FIG. 10; further, in the case where the approach of Patent Reference 2 is applied, the curvature radius of the curved surface in the neighborhood of the recess bottom 028 of the annular recess is so small that the curvature radius greatly changes in the neighborhood and the stress concentration is easily caused, the recess bottom 028 being depicted in FIG. 11.

In this way, in the conventional technologies as described above, there has been a difficulty that the stress concentration is inclined to be caused in the recess bottom area; in addition, there has been a difficulty that the stress concentration is also inclined to appear at the root part regarding the hub part on the rear surface side. And, the difficulties accompany the problems regarding the strength or the durability of the product.

In view of the above-described difficulties in the conventional technologies, the present invention aims at providing a turbine rotor in which the rotational inertia of the turbine rotor can be reduced without changing the geometry of the blade part, whereas the turbine rotor is provided with the rear side surface so that the stress concentration appearing at the root part regarding the hub part on the rear surface side is constrained in order that the strength and the durability of the turbine rotor can be enhanced.

Means to Solve the Subjects

In order to overcome the difficulties in the conventional technologies as described above, a first aspect of the present invention discloses a turbine rotor that includes, but not limited to, a rod-shaped hub part connected to a rotor shaft; and a plurality of blade parts formed around an outer periphery of the hub part, the hub part and the blade parts being integrated into one piece, wherein a diameter of the hub part gradually increases toward a rear side surface on an end side of the hub part in a rotation shaft direction;

an annular recess is formed on the rear side surface annularly around the rotation shaft;

a cross-section of the annular recess in the rotation shaft direction is formed from a curve geometry divided in half by a major axis, the curve geometry being a major arc of an oval shape or an egg shape symmetry with respect to the major axis; and the major axis is placed to be in line with the rear side surface.

According to the above-described invention, the diameter of the hub part around the rotation axis gradually increases toward the rear side surface on the end side of the hub part in the rotation shaft direction; the annular recess is formed on the rear side surface annularly around the rotation shaft; the cross-section of the annular recess in the rotation shaft direction is formed from the curve geometry divided in half by the major axis, the curve geometry being the major arc of the oval shape or the egg shape symmetry with respect to the major axis and, the major axis is placed to be in line with the rear side surface.

Thus, the curvature smoothly changes along the cross-section of the annular recess; a larger curvature radius can be adopted. Hence, such stress concentration as appears in the neighborhood of the bottom area regarding the cross-section of the annular recess can be constrained, the stress concentration appearing in the cross-section bottom area in the conventional technologies as shown in FIGS. 10 and 11, with a sudden change regarding the cross-section curvature.

As a result, the stress concentration appearing at the root part regarding the hub part on the rear surface side can be prevented. In addition, the strength and the durability of the turbine rotor can be enhanced.

In general, stress concentration factors a can be evaluated in a reference chart as shown in FIG. 6; for instance, in FIG. 6, the stress concentration factor a increases as the parameter p/t along the lateral axis decreases; whereby, the letters p and t denote the radius of the arc regarding the notch bottom, and the depth regarding the notch, respectively. Thus, the stress concentration factor a can be reduced when the radius p is increased or the depth t is reduced.

According to the above described disclosure, in a manner in which the cross-section of the annular recess is configured with a part of the major arc of an oval shape or an egg shape, the major arc being formed so that the oval shape or the egg shape is divided by the major axis as a symmetrical axis of the oval shape or the egg shape; and, the major axis is placed in the rear side surface. In this way, the stress concentration factor appearing on and along the cross-section of the annular recess in the section can be constrained without a sudden change in the curvature along the cross-section; and, the stress concentration appearing in the cross-section bottom area in the conventional technologies can be reduced. In other words, the notch arc radius p can be made larger and the notch depth t can be made shallower. Thus, the stress concentration appearing at the root part regarding the hub part on the rear surface side can be constrained.

Further, a second aspect of the present invention discloses a turbine rotor that includes, but not limited to, a rod-shaped hub part connected to a rotor shaft; and a plurality of blade parts formed around an outer periphery of the hub part, the hub part and the blade parts being integrated into one piece, wherein a diameter of the hub part gradually increases along the rotation shaft direction toward a rear side surface on an end side of the rotation shaft direction;

an annular recess is formed on the rear side surface annularly around the rotation shaft; and a cross-section of the annular recess in the rotation shaft direction is formed from a part of either an arc of a circle or a curve geometry being a major arc of an oval shape or an egg shape symmetry with respect to a major axis;

further wherein a center of the arc of the circle or the major axis is placed outer of the hub part than the rear side surface, the major axis being parallel to the rear side surface.

According to the second aspect of the above described invention, as is the case with the first aspect of the present invention, the stress concentration factor can be reduced and the stress concentration can be constrained. Moreover, in the second aspect, the center of the arc of the circle is placed outside of the hub part as well as the rear side surface in a case where the cross-section of the annular recess includes a part as the arc of a circle; on the other hand, in similar way, the major axis is placed outside of the hub part as well as the rear side surface in a case where the cross-section of the annular recess includes the part of the major arc of an oval shape or an egg shape. In this way, the curvature radius along the cross-section of the second aspect can be made larger than the curvature radius along the cross-section of the first aspect, the cross-section of the first aspect being formed with a part of the major arc of an oval shape or an egg shape. Thus, the stress concentration appearing at the root part regarding the hub part on the rear surface side can be further constrained.

Further, a preferable embodiment in the above-described first and second aspects of the present invention is the turbine rotor, wherein the annular recess comprises intersection points of the rear side surface with either the arc of circle or the curve geometry symmetry with respect to the major axis, and one of the intersection points which is located at an outer periphery side is positioned at a position approximately half of a diameter of the blade part, while the other intersection point which is located at an inner periphery side is positioned at a position in a neighborhood of an intersection of the rear side surface with the rotor shaft.

According to the above-described configuration, the outer periphery side point out of the intersection points of the cross-section of the annular recess and the rear side surface is placed at a position whose distance from the rotation axis is approximately half of the outer diameter of the blade part. Thus, a sufficient wall thickness is achieved in the outer periphery side area of the hub part supporting the blade parts.

Further, the hub part and the blade parts are manufactured as an integrated one-piece product by means of casting and so on. In addition, the turbine rotor rotates with a high speed. Thus, the balancing of the mass distribution regarding the turbine rotor becomes necessary in preparation of a high speed operation. Accordingly, a space from which a part of the material (mass) of the hub part can be removed is required; and, a plane area is achieved on the rear side surface on the outer periphery side of the hub part, so that a part of material (mass) can be removed from the hub space.

Further, a preferable embodiment in the above-described first and second aspects of the present invention is the turbine rotor, wherein the cross-section of the annular recess is configured without a linear portion.

In other words, according to the above, the cross-section of the annular recess includes no linear portion, and the cross-section is formed with an arc, a part of major arc of an oval shape or an egg shape; thus, the cross-section can be prevented, to a maximum level, from being influenced by the sudden change of the curvature radius at the connection point between the curved part of the cross-section and the linear portion. Thus, the stress concentration appearing at the root part regarding the hub part on the rear surface side can be effectively constrained.

Further, a preferable embodiment in the above-described first and second aspects of the present invention is the turbine rotor, wherein the curve geometry being a major arc symmetry with respect to the major axis is formed in an oval, and a minor axis diameter of the oval is 3% to 10% of the diameter of the blade part.

In relation to the above, the range of the interval from 3% to 10% regarding the ratio between the minor axis diameter of the oval and the outer diameter of the blade part is determined based on the numerical computation analysis; in a case where the ratio is below 3%, it is difficult to obtain the reduction effect regarding the rotational inertia and achieve the space (i.e. the plane area such as a part of the rear side surface on the outer periphery side of the hub part) from which a part of the material of the hub part is removed. In a case where the ratio exceeds 10%, the depth of the annular recess becomes excessive, the adverse effect on the thickness of the wall on the outer periphery side of the hub part, and the reverse effect on the strength of the whole turbine rotor is caused, the wall supporting the blade parts of the turbine rotor.

Effects of the Invention

The first aspect of the present invention can provide a turbine rotor in which the rotational inertia of the turbine rotor can be reduced without changing the geometry of the blade part, whereas the turbine rotor is provided with the rear side surface so that the stress concentration appearing at the root part regarding the hub part on the rear surface side is constrained. Thus, the strength and the durability of the turbine rotor can be enhanced.

Further, according to the second aspect of the present invention, as is the case with the first aspect of the present invention, the stress concentration factor can be reduced and the stress concentration can be constrained. Moreover, in the second aspect, the center of the arc of the circle is placed outside of the hub part as well as the rear side surface in a case where the cross-section of the annular recess includes the part as the arc of a circle; on the other hand, the major axis is placed outside of the hub part as well as the rear side surface in a case where the cross-section of the annular recess includes the part of the major arc of an oval shape or an egg shape.

In this way, the curvature radius along the cross-section of the second aspect can be made larger than the curvature radius along the cross-section of the first aspect, the cross-section of the first aspect being formed with a part of the major arc of an oval shape or an egg shape. Thus, the stress concentration appearing at the root part regarding the hub part on the rear surface side can be further constrained.

BRIEF DESCRIPTION OF THE DRAWINGS

FIG. 6 shows a general characteristic chart regarding stress concentration factor a;

DETAILED DESCRIPTION OF THE PREFERRED MODES OR EMBODIMENTS

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

(First Mode)

Figure 1:
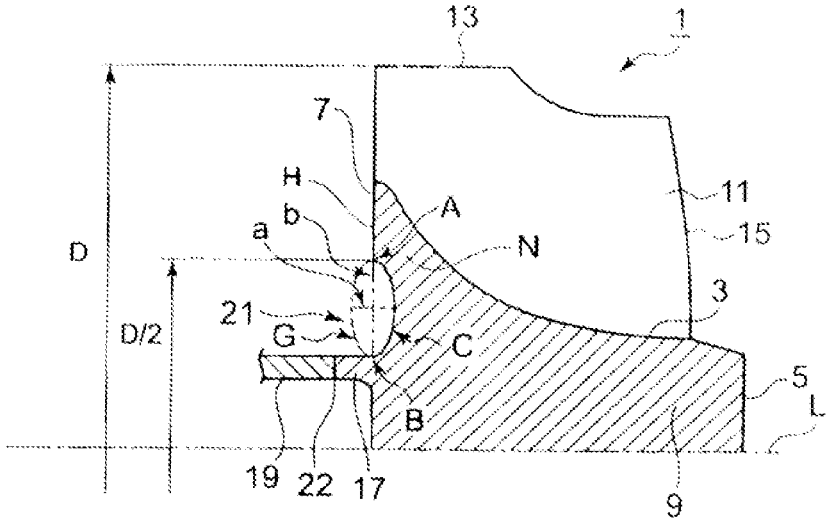
FIG. 1 shows a cross-section of a turbine rotor according to a first mode of the present invention.

Based on the examples of the turbine rotors of the turbochargers for vehicle use, marine use and the like, the present invention is now explained. FIG. 1 shows a turbine rotor 1 according to a first mode of the present invention, in a cross section along the rotation axis direction; the turbine rotor 1 (hereafter also called simply as a rotor) forms a rotation body around the rotation axis in the axis direction; further, in the rotor, a hub part 9 including, but not limited to, a hub line surface (a hub surface) 3, a front side surface 5 and a rear side surface 7 is integrated with a plurality of blade parts 11 that are formed on the hub line surface 3; namely, the hub part 9 and the blade part are integrated into one piece that is formed by means of injection molding, casting, sintering and so on.

The hub line surface 3 forms a curved outer periphery surface of the hub part 9 so that the diameter of the hub part around the rotation axis gradually increases along the rotation axis direction toward the rear side surface 7 from the front side surface 5; on the curved outer periphery surface of the hub part, the blade parts 11 are installed upright along the rotation axis direction.

Further, a front edge 13 of each blade part 11 is formed on the outer periphery side of the turbine rotor, each blade part 11 being formed also along the radial direction; a trailing edge 15 of each blade part 11 is formed on the working fluid outlet side of the turbine rotor, the trailing edge being located rather inner periphery side of the turbine rotor along the rotation axis direction. The working gas is fed into the space between the front edge 13 and the adjacent front edge 13, streams along the rotation axis direction, and is discharged through a space between a trailing edge 15 and the adjacent trailing edge 15; thus, the torque acts on the hub part 9.

Further, on the rear side surface 7 of the hub part 9, a welding joint shelf 17 is annularly protruded upright so that a front side end of a rotor shaft 19 is jointed to the welding joint shelf 17 at a welding joint part 22. Incidentally, the joint structure regarding the rotor shaft 19 may be not a welding structure; the joint structure may be performed so that a hollow space is provided in a central area around the rotation axis on the rear surface side of the hub part 9, the rotor shaft 19 is fit into the hollow space, and the rotor shaft 19 is jointed to the hub part 9.

Further, on the rear side surface 7 of the hub part 9, an annular recess 21 is formed annularly around a center line L of rotation (i.e. the rotation axis) as well as around the rotor shaft 19. As shown in FIG. 1, the cross-section of the annular recess 21 whose plane includes the rotation axis is configured with a part of an oval shape G (namely, a major arc C of the oval G that is symmetric with regard to the major axis of the oval). In other words, the oval has the minor diameter a and the major diameter b, and the oval (i.e. the cross-section) is configured with the major arcs C. Thereby, the major axis regarding the major arc C of the oval is placed on the rear side surface 7; a right part of the oval that is divided by the major axis forms the major arc C (in FIG. 1). Further, in other words, the curved shape that forms the annular recess 21 is simply configured with the major arc C of an oval, and the curved shape does not include a straight linear portion.

On the outer periphery side of the turbine rotor, an intersection point A of the major arc C and the line formed by the rear side surface 7 is located at a point whose distance from the rotation axis is approximately half of the diameter D/2 (i.e. a distance of D/4), whereby the length D is a diameter of the blade part 11; on the central part side (inner periphery side) of the turbine rotor, an intersection point B of the major arc C and the line formed by the rear side surface is located at an intersection point of the line formed by the outer side surface of the welding joint shelf 17 and the line formed by the rear side surface 7.

Since the intersection point A is located at a point whose distance from the rotation axis is approximately half of the diameter D/2 (i.e. a distance of D/4) whereby the length D is a diameter of the blade part 11, a sufficient wall thickness N is achieved in the outer periphery side area of the hub part 9 supporting the blade parts; thus, the strength reduction regarding the whole turbine rotor 1 can be prevented, the strength reduction being attributable to the formation of the annular recess 21.

Further, the hub part 9 and the blade parts 11 are manufactured as an integrated one-piece product by means of casting and so on. In addition, the turbine rotor 1 rotates with a high speed. Thus, the balancing of the mass distribution regarding the turbine rotor becomes necessary in preparation of a high speed operation. Accordingly, a space from which a part of the material (mass) of the hub part can be removed is required; and, a plane area H is achieved on the rear side surface 7, as well as on the outer periphery side of the recess part 21, so that a part of material (mass) can be removed from the hub space.

From the reasons as described above, the location of the intersection point A is established. In providing the intersection point B, the location of the point B is established so that the upper side surface of the welding joint shelf 17 is continuously and smoothly prolonged to the inner surface of the recess part 21; thus, the number of the points where stress concentration may be generated is reduced as small as possible. In other words, if the point B is located on the outer periphery side of the welding joint shelf 17 and the point B forms a corner point of a step, stress concentration may be caused at the intersection point B of the corner.

Figure 6:
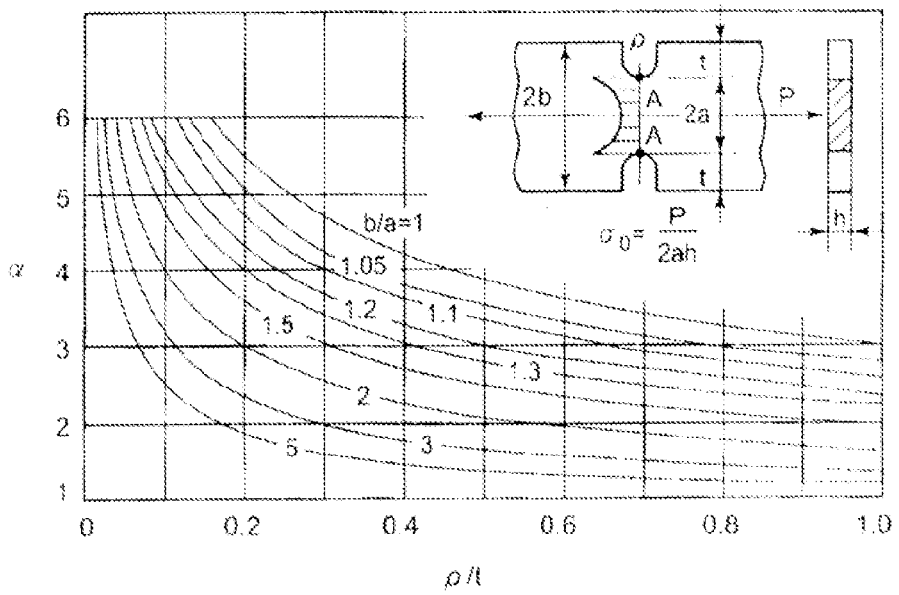
Figure 7:
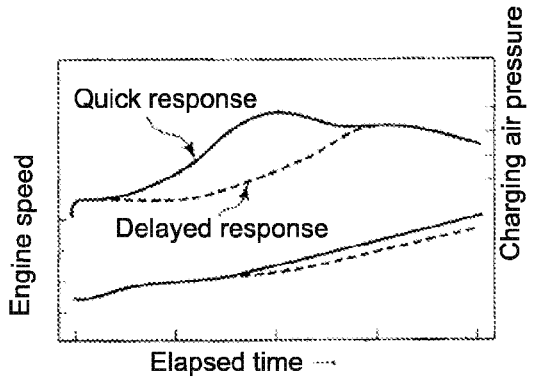
FIG. 7 explains an exemplar response characteristic regarding a turbine rotor behavior.
Figure 8:
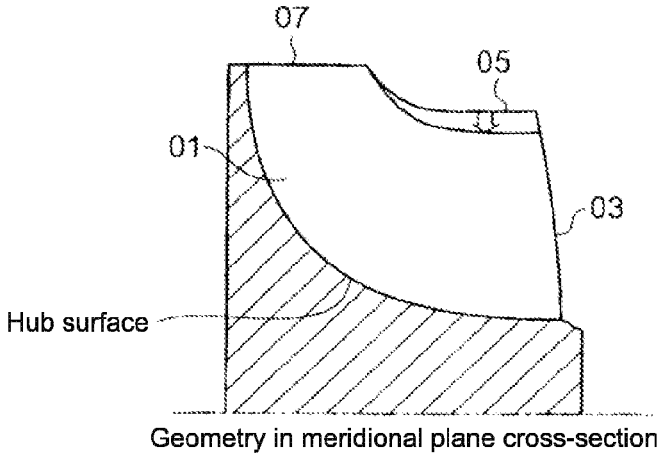
FIG. 8 explains a design modification regarding a turbine rotor blade.
Figure 9:
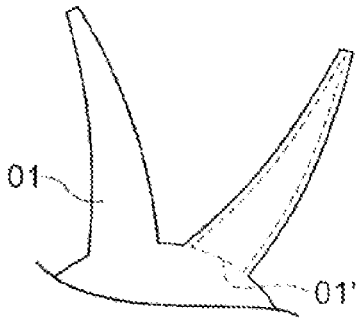
FIG. 9 explains a design modification regarding a turbine rotor blade.

Hereby, the explanation regarding stress concentration factor is now given. As shown in a typical literature of strength of material such as JSME mechanical engineers' handbook, an example of a general chart regarding stress concentration factor a such as depicted in FIG. 6 is shown. The example relates to a case where a long flat plate (i.e. a 2-dimension model) has a notch on each of both the sides of the flat plate; the stress concentration factor a increases as the parameter p/t along the lateral axis decreases; whereby, the letters p and t denote the radius of the arc regarding the notch bottom, and the depth regarding the notch, respectively. Hence, it is understood that the stress concentration factor a can be reduced when the radius p is increased or the depth t is reduced.

Accordingly, in order that the radius p (of the arc regarding the notch bottom) is increased or the depth t (regarding the notch) is reduced, the cross-section of the annular recess 21 is formed with a major arc of an oval; thus, the stress concentration factor can be reduced in comparison with the conventional case where the abrupt change of the curvature is formed in the bottom area of the conventional recess part. Moreover, on the rear side surface 7, a plane area H is achieved, so that a part of material can be removed from the hub space.

As a result, the rotational inertia of the turbine rotor 1 can be reduced without changing the geometry of the blade part 11, whereas the stress concentration appearing at the root part regarding the hub part on the rear surface side 7 is constrained. Thus, the strength and the durability of the turbine rotor can be enhanced.

Figure 4:
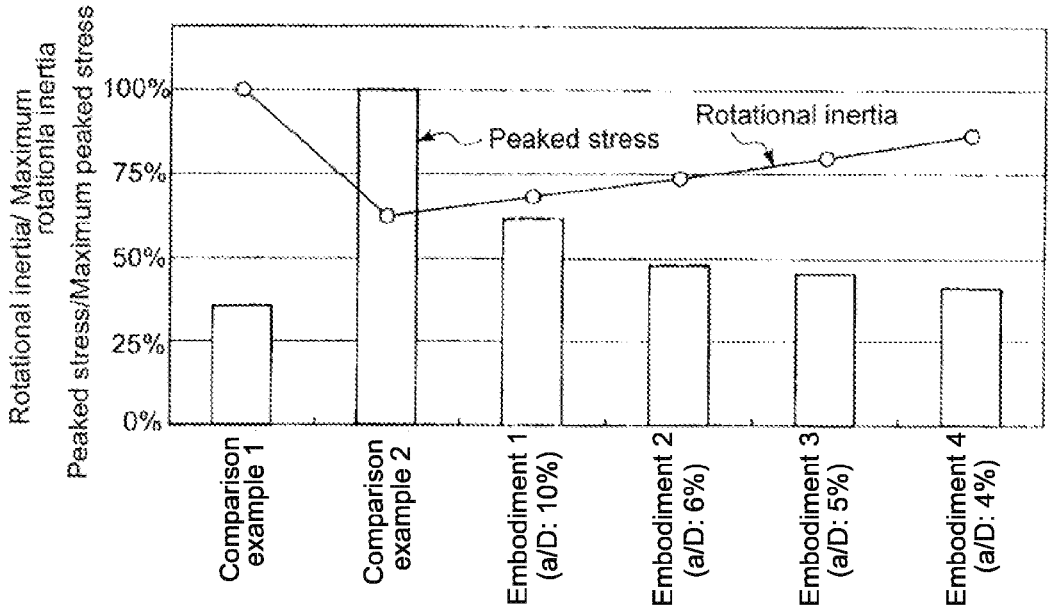
FIG. 4 shows the comparison regarding the peaked stresses as well as the rotational inertia among the comparison examples and embodiments.
Figure 5A:
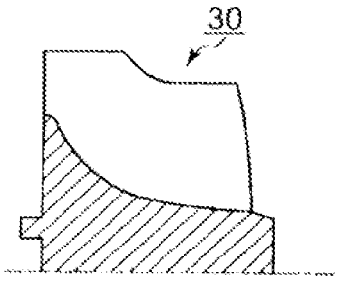
FIGS. 5(*a*) and 5(*b*) explain the first comparison example and the second comparison example, respectively.
Figure 5B:
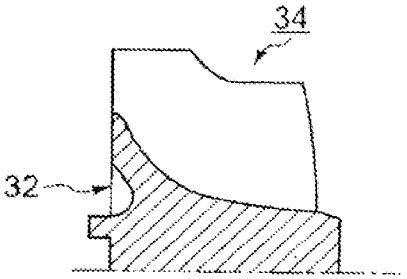

In the next place, based on FIGS. 4, 5(*a*) and 5(*b*), the numerical computation results regarding the stresses that occur at the root part (as to the hub part on the rear surface side) are explained.

The comparison example 1 that appears with regard to the lateral axis of FIG. 4 is a case example in which the turbine rotor 1 is not provided with the annular recess as is the case with the example of FIG. 5(*a*) depicting a cross-section of a turbine rotor 30 provided with no annular recess part.

Figure 10:
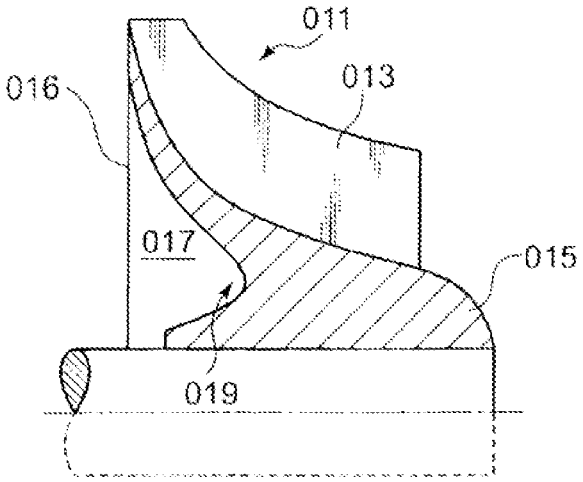
Related Art Fig. 10
FIG. 10 explains a conventional turbine rotor.
Figure 11:
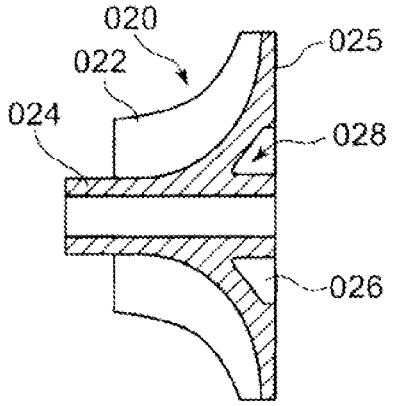
Related Art Fig. 11
FIG. 11 explains a conventional turbine rotor.

On the other hand, in the comparison example 2 that appears with regard to the lateral axis of FIG. 4 is a case example in which the cross-section of the annular recess is of a water droplet shape 32 as depicted in FIG. 5(*b*) depicting a cross-section of a turbine rotor 34, the cross-section being similar to the corresponding cross-section as shown in FIG. 10 or 11; thereby, the annular recess is deep, the cross-section the bottom of the recess is pointed and the curvature radius at the bottom is small.

Further, the embodiments 1 to 4 that appear with regard to the lateral axis of FIG. 4 are the (embodiment) cases in which the cross-section of the annular recess is configured with the major arc of the oval according to the first mode of the invention; thereby, FIG. 1 shows the cross-section of the turbine rotor 1 according to the first mode of the present invention. In the embodiment (case) 1, the ratio (a/D) of the diameter D to the minor axis diameter a of the oval is equal to 10%; in the embodiment (case) 2, the ratio (a/D) is equal to 6%; in the embodiment (case) 3, the ratio (a/D) is equal to 5%; and, in the embodiment (case) 4, the ratio (a/D) is equal to 4%.

Further, the vertical axis of FIG. 4 denotes the peaked stresses regarding the comparison example cases and the embodiment cases; thereby, the level of the peaked stress in the comparison example case 2 is assumed to be 100%; and, the levels of the peaked stresses regarding the comparison example cases and the embodiment cases 1 to 4 are expressed with regard to this reference 100%.

Further, the vertical axis of FIG. 4 denotes the rotational inertia regarding the comparison example cases and the embodiment cases; thereby, the level of the rotational inertia in the comparison example case 1 is assumed to be 100%; and, the levels of the rotational inertia regarding the comparison example cases and the embodiment cases 1 to 4 are expressed with regard to this reference 100%.

When the peaked stresses are compared among the comparison example cases 1 and 2 and the embodiment cases 1 to 4, the peaked stress becomes the maximum in the comparison example 2 where the cross-section of the annular recess is of the water droplet shape; and, the level of the maximum stress is taken as 100% and the levels of the peaked stresses regarding the comparison example cases and the embodiment cases 1 to 4 are expressed with regard to this reference 100%. Thus, it is understood that the peaked stress becomes the minimum in the comparison example case 1 where no annular recess is formed; the peaked stress becomes smaller from the embodiment 1 to 4, in sequence. In other words, it is confirmed that, when the minor axis diameter of the oval becomes smaller and the depth of the annular recess becomes shallow, the peaked stress level gets closer to the level of the comparison example 1 as the reference case.

Further, when the rotational inertia is compared among the comparison example cases 1 and 2 and the embodiment cases 1 to 4, the rotational inertia becomes the maximum in the comparison example case 1 where no annular recess is formed and the rotational inertia becomes the minimum in the comparison example case 2 where the cross-section of the annular recess is of the water droplet shape; and, the level of the maximum rotational inertia is taken as 100% and the levels of the rotational inertia regarding the comparison example cases and the embodiment cases 1 to 4 are expressed with regard to this reference 100%. Thus, it is understood that the rotational inertia becomes the minimum in the comparison example case 2 where the cross-section of the annular recess is of a water droplet shape as in the case of the comparison example 2 where no annular recess is formed, though the generated stress level is the minimum; the rotational inertia becomes greater from the embodiment 1 to 4, in sequence. In other words, it is confirmed that, when the minor axis diameter of the oval becomes smaller and the depth of the annular recess becomes shallow, the rotational inertia level gets closer to the level of the comparison example 1 as the reference case.

Based on the above-described comparison, in a case where the annular recess is not provided as in the case of the comparison example 1, the level of the generated concentrated-stress is low but the rotational inertia becomes great; in a case where the cross-section of the annular recess is of a water droplet shape as in the case of the comparison example 2, the rotational inertia is small but the level of the generated concentrated-stress is high. In this way, the comparison summary can be confirmed.

As described above, according to the present invention, regarding the level of the concentrated stress as well as regarding the rotational inertia, the intermediate properties between the comparison examples 1 and 2 can be adopted; thus, while the rotational inertia can be reduced, the stress concentration appearing at the root part regarding the hub part on the rear surface side 7 can be constrained.

Incidentally, in establishing the ratio of a/D, the ratio may be previously determined in view of the relationship regarding the rotational inertia as well as the concentrated stress levels among the embodiment examples 1 to 4, the relationship being explained in the above-described context.

In addition, with regard to the range of the ratio a/D, the interval [3%, 10%] that includes the interval [4%, 10%] is appropriate, the latter interval [4%, 10%] being indicated in FIG. 4 whose result is obtained by the numerical computation analysis. Hereby, for instance, the closed interval [3%, 10%] means a set of x % where $3 \leq x \leq 4$.

The reason of the setting of the above-described interval range is that it is difficult to obtain the reduction effect regarding the rotational inertia, in a case where the ratio is below 3% and achieve the space (i.e. the plane area such as a part of the rear side surface 7); further, in a case where the ratio exceeds 10%, the depth of the annular recess becomes excessive, and the adverse effect on the thickness of the wall on the outer periphery side of the hub part as well as the reverse effect on the strength of the whole turbine rotor is caused, the wall supporting the blade parts of the turbine rotor. Thus, the interval range [3%, 10%] is preferable.

As described thus far, in the first mode of the present invention, the cross-section of the annular recess 21 whose plane includes the rotation axis is explained as the oval shape G. As a matter of course, the cross-section may be of an egg shape, instead of an oval shape. In other word, the cross-section may be, for instance, configured with a part of an oval shape and a semicircle. To be more specific, the cross-section of the egg-shape may be configured with a part of an oval shape and a part of circle so that both the parts are continuously and smoothly connected without the discontinuity at the connecting points, so long as the a larger radius of curvature is achieved. Incidentally, the egg-shape cross-section should not include a linear portion therein; when a linear portion is included in the egg-shape cross-section, the curvature radius greatly changes at the ends of the linear portion. In this way, so long as the egg shaped cross-section regarding the annular recess includes only a part of a major arc regarding an oval and a part of a circle so that both the parts are continuously and smoothly connected without the discontinuity at the connecting points, smooth continuity is achieved at the connection points. If the egg-shape cross-section includes a line segment, the curvature radius greatly changes at the intersection points of the line segment and the curved part of the cross-section; thus, the stress concentration inclined to be caused in a case where the line segment is included in the cross-section. Incidentally, the egg-shape cross-section should not include a linear portion therein; when a linear portion is included in the egg-shape cross-section, the curvature radius greatly changes at the ends of the linear portion. In this way, so long as the egg shaped cross-section regarding the annular recess includes only a part of a major arc regarding an oval and a part of a circle so that both the parts are continuously and smoothly connected without the discontinuity at the connecting points, smooth continuity is achieved at the connection points. If the egg-shape cross-section includes a line segment, the curvature radius greatly changes at the intersection points of the line segment and the curved part of the cross-section; thus, the stress concentration inclined to be caused in a case where the line segment is included in the cross-section.

(Second Mode)

Figure 2:
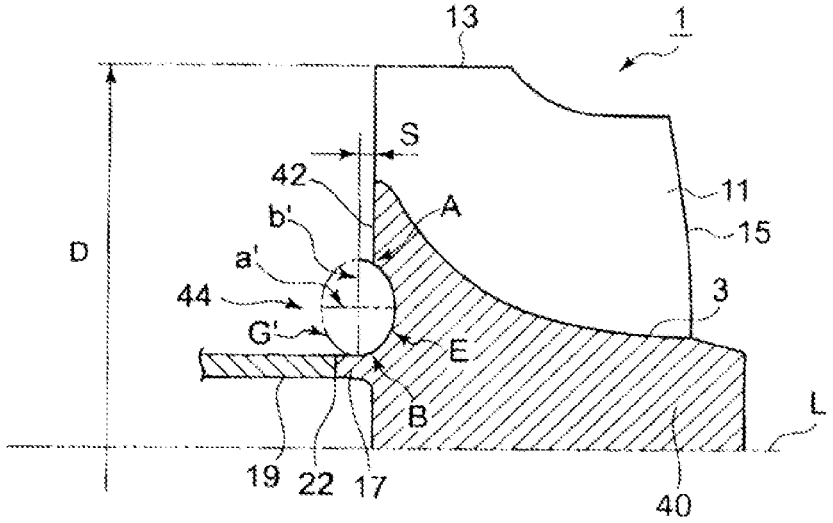
FIG. 2 shows a cross-section of a turbine rotor according to a second mode of the present invention.

In the next place, based on FIG. 2, a second mode of the present invention is now explained. Incidentally, the same components in the second mode as in the first mode are given common numerals; and, explanation repetitions are omitted.

As shown in FIG. 2, on the rear side surface 42 of the hub part 40, an annular recess 44 is foamed annularly around a center line L of rotation (i.e. the rotation axis) as well as around the rotor shaft 19; the cross-section of the annular recess 44 in a cross-section whose plane includes the rotation axis is configured with a part of an oval shape G' (namely, a major arc E of the oval G' that is symmetric with regard to the major axis of the oval). In other words, the oval has the minor diameter a' and the major diameter b', and the oval is configured with the major arcs E. Thereby, the major axis regarding the major arc E of the oval is not placed on the rear side surface 42; the major axis regarding the major arc E is shifted by a distance S (is moved to a position parallel to the rear side surface 42 in the left side in FIG. 2) toward the outer side of the hub part 40; thus, a part of the major arc of the oval forms the cross-section of the annular recess 44. In other words, the curved cross-section of the annular recess 44 is simply formed by a part of the major arc of the oval without including a linear portion.

Further, in a case where the distance S is increased, the major diameter b' can be made long; accordingly, when the distance S is increased, the cross-section of the annular recess 44 can closer to a basic geometry according to the comparison example 1 that is explained by use of FIG. 4 in relation to the first mode of the invention.

In addition, if the major axis (i.e. the part of the major diameter b') regarding the major arc E is shifted by a distance S toward the inner side of the hub part 40, the major arc E is forced to be connected (continued) to a line at the upper (top) side and the bottom side of the major arc; accordingly, at the top and bottom points, the curvature radius is so greatly changes that stress concentration may be caused. In this way, it becomes necessary that the major axis regarding the major arc E be shifted by a distance S toward the outer side of the hub part 40 not toward the inner side of the hub part 40.

Incidentally, the location (i.e. the distance from the rotation axis) of the point A in the second mode is the same as the location of the point A a in the first mode (in the meaning of the distance from the rotation axis), the point A in the second mode being the intersection point of the major arc E and the rear side surface 42 on the outer periphery side of the turbine rotor; the location of the point B in the second mode is the same as the location of the point B in the first mode, the point B in the second mode being the intersection point of the major arc E and the rear side surface 42 on the inner periphery side of the turbine rotor.

According to the second mode of the present invention, the stress concentration factor can be reduced so that the concentrated stress is restrained, as is the case with the first mode. Moreover, in the second mode, the major diameter b' (i.e. the major axis) of the oval is placed outside of the hub part 40 as well as the rear side surface 42 (toward the left side in FIG. 2); accordingly, the curvature radius of the major arc E can be set larger than the curvature radius of the major arc C in the first mode. Thus, in comparison with the first mode, the stress concentration factor can be reduced; and, the stress concentration appearing at the root part regarding the hub part on the rear surface side 7 can be constrained.

(Third Mode)

Figure 3:
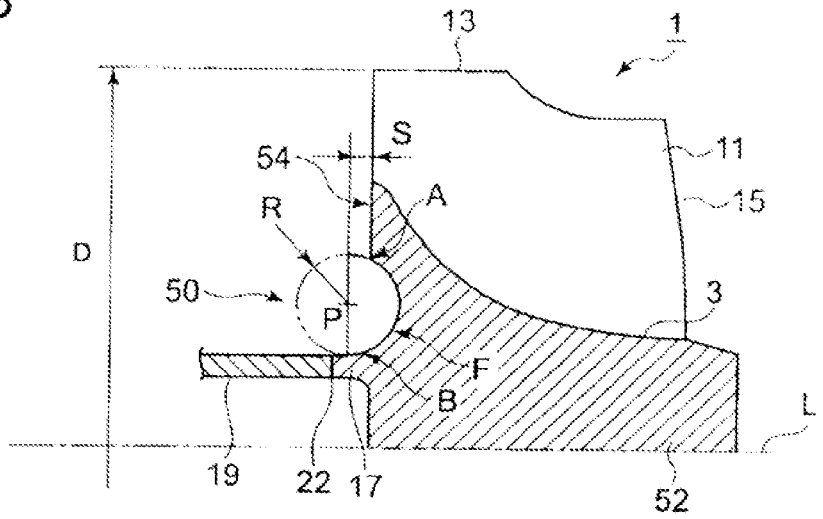
FIG. 3 shows a cross-section of a turbine rotor according to a third mode of the present invention.

In the next place, based on FIG. 3, a third mode of the present invention is now explained. Incidentally, the same components in the third mode as in the first mode and the second mode are given common numerals; and, explanation repetitions are omitted.

In this third mode, the oval cross-section in the second mode is replaced by a circle. Thus, the cross-section of the annular recess 50 whose plane includes the rotation axis is formed in the third mode.

As shown in FIG. 3, on the rear side surface 54 of the hub part 52 that configures the turbine rotor 1, an annular recess 50 is formed annularly around a center line L of rotation (i.e. the rotation axis) as well as around the rotor shaft 19; the cross-section of the annular recess 50 whose plane includes the rotation axis is configured with a part, namely, an arc F of a circle of a radius R. The center P of the arc F is located away from the rear side surface 54, toward the outside of the hub part 52, by a distance S, as is the case with the second mode. In other words, the curved cross-section that configures the cross-section of the annular recess 50 is provided with no linear portion, and a single arc. In addition, the single arc is formed as a part of a semicircle.

The location (i.e. the distance from the rotation axis) of the point A in the third mode is the same as the location of the point A in the first mode, the point A in the third mode being the intersection point of the arc F and the rear side surface 54 on the outer periphery side of the turbine rotor; the location of the point B in the third mode is the same as the location of the point B in the first mode, the point B in the third mode being the intersection point of the arc F and the rear side surface 54 on the inner periphery side of the turbine rotor.

As described above, when the cross-section of the annular recess 50 is formed according to the third mode of the present invention, the third mode has the same effects as the second mode. Further, according to the third mode, the cross-section of the annular recess 50 is configured simply with an arc as a part of a circle in comparison with the oval shape cross-section or the egg shape cross-section, the oval shape and the egg shape being symmetrical with regard to the major axes thereof; accordingly, the manufacturing and machining of the turbine rotor can be easily performed. Further, in a case where the distance between the point A and the point B is limited to a prescribed level and the protruding length regarding the welding joint shelf 17 cannot exceeds an allowable limit, the cross-section of the annular recess 50 can be arranged so that the cross-section does not reach the welding joint part 22; in this way, the curvature radius of the cross-section of the annular recess 50 can be smaller than the curvature radius of the oval shape cross-section or the egg shape cross-section, the oval shape and the egg shape being symmetrical with regard to the major axes thereof. Thus, in establishing the cross-section of the annular recess 50, the degree of freedom can be enhanced.

INDUSTRIAL APPLICABILITY

The present invention suitably provides a turbine rotor in which the rotational inertia of the turbine rotor can be reduced without changing the geometry of the blade part, whereas the turbine rotor is provided with the rear side surface so that the stress concentration appearing at the root part regarding the hub part on the rear surface side is constrained. Thus, the strength and the durability of the turbine rotor can be enhanced.

The invention claimed is:

1. A turbine rotor comprising:

a rod-shaped hub part connected to a rotor shaft; and a plurality of blade parts formed around an outer periphery of the hub part, the hub part and the blade parts being integrated into one piece, wherein a diameter of the hub part gradually increases toward a rear side surface being on an end side of the hub part in a rotation shaft direction and extending in a direction perpendicular to the rotor shaft;

an annular recess and a plane area extending in the direction perpendicular to the rotor shaft are formed on the rear side surface, the plane area being located on an outer periphery side of the annular recess;

a cross-section of the annular recess in the rotation shaft direction is formed from a curve geometry divided in half by a major axis, the curve geometry being a major arc of an oval shape having a major axis diameter and a minor axis diameter symmetry with respect to the major axis;

the major axis is placed to be in line with the rear side surface;

the curve geometry being a major arc symmetry with respect to the major axis is formed in an oval; and the minor axis diameter of the oval is 3% to 10% of the diameter of the blade part.

2. The turbine rotor according to claim 1, wherein the annular recess comprises intersection points of the rear side surface with the curve geometry symmetry with respect to the major axis, and one of the intersection points which is located at an outer periphery side is positioned at a position approximately half of a diameter of the blade part, while the other intersection point which is located at an inner periphery side is positioned at a position in a neighborhood of an intersection of the rear side surface with the rotor shaft.

3. The turbine rotor according to claim 2, wherein a welding joint shelf is annularly protruded so that a front side end of the rotor shaft is welded to the welding joint shelf; and a position of the inner periphery side is located at an intersection point of a line formed by an outer side surface of the welding joint shelf and a line formed by the rear side surface.

4. The turbine rotor according to claim 1, wherein the cross-section of the annular recess is configured without a linear portion.

5. A turbine rotor comprising:

a rod-shaped hub part connected to a rotor shaft; and a plurality of blade parts formed around an outer periphery of the hub part, the hub part and the blade parts being integrated into one piece, wherein a diameter of the hub part gradually increases along the rotation shaft direction toward a rear side surface on an end side of the rotation shaft direction, the rear side surface extending in an orthogonal direction to the rotor shaft;

an annular recess and a plane area extending in the direction perpendicular to the rotor shaft are formed on the rear side surface, the plane area being located on an outer periphery side of the annular recess; and a cross-section of the annular recess in the rotation shaft direction is formed from a part of either an are of a circle or a curve geometry being a major are of an oval shape or an egg shape symmetry with respect to a major axis;

further wherein a center of the are of the circle or the major axis is placed outer of the hub part than the rear side surface, the major axis being parallel to the rear side surface; and the annular recess comprises intersection points of the rear side surface with either the arc of circle or the curve geometry symmetry with respect to the major axis; and one of the intersection points which is located at an outer periphery side is positioned at a position approximately half of a diameter of the blade part, while the other intersection point which is located at an inner periphery side is positioned at a position in a neighborhood of an intersection of the rear side surface with the rotor shaft.

6. The turbine rotor according to claim 5, wherein the cross-section of the annular recess is configured without a linear portion.

7. The turbine rotor according to claim 5, wherein the curve geometry being a major arc symmetry with respect to the major axis is formed in an oval; and a minor axis diameter of the oval is 3% to 10% of the diameter of the blade part.

8. The turbine rotor according to claim 5, wherein a welding joint shelf is annularly protruded so that a front side end of the rotor shaft is welded to the welding joint shelf; and a position of the inner periphery side is located at an intersection point of a line formed by an outer side surface of the welding joint shelf and a line formed by the rear side surface.

* * * * *